US008668158B2

(12) United States Patent
Dallimore et al.

(10) Patent No.: US 8,668,158 B2
(45) **Date of Patent: *Mar. 11, 2014**

(54) HORIZONTAL SHAFT IMPACT CRUSHER

(75) Inventors: Rowan Dallimore, Bath (GB); Knut Kjaerran, Svedala (SE); Andreas Forsberg, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 327 days.

This patent is subject to a terminal disclaimer.

(21) Appl. No.: 13/083,072

(22) Filed: Apr. 8, 2011

(65) Prior Publication Data

US 2011/0253822 A1 Oct. 20, 2011

(30) Foreign Application Priority Data

Apr. 16, 2010 (SE) ..... 1050377

(51) Int. Cl.
*B02C 13/09* (2006.01)
*B02C 1/04* (2006.01)

(52) U.S. Cl.
USPC ..... 241/189.1; 241/289

(58) Field of Classification Search
USPC ..... 241/189.1, 286–289
See application file for complete search history.

(56) References Cited

U.S. PATENT DOCUMENTS

| | | | | |
|---|---|---|---|---|
| 3,480,214 | A * | 11/1969 | Wageneder | 241/189.1 |
| 3,659,794 | A * | 5/1972 | Hemesath | 241/189.1 |
| 3,788,562 | A | 1/1974 | Greenlay et al. | |
| 4,017,035 | A | 4/1977 | Stuttmann | |
| 5,255,869 | A | 10/1993 | Smith | |
| 5,713,527 | A | 2/1998 | Hemesath et al. | |
| 6,189,820 | B1 | 2/2001 | Young | |
| 6,745,966 | B2 | 6/2004 | Heukamp | |
| 2013/0146692 | A1 | 6/2013 | Dallimore et al. | |

FOREIGN PATENT DOCUMENTS

| | | |
|---|---|---|
| CN | 2643998 Y | 9/2004 |
| DE | 39 11 086 | 4/1990 |
| DE | 43 12 509 | 10/1994 |

(Continued)

OTHER PUBLICATIONS

Notification of First Office Action (with English Translation) in Chinese patent application No. 201180019393.5 dated Dec. 4, 2013.

(Continued)

*Primary Examiner* — Faye Francis
(74) *Attorney, Agent, or Firm* — Morgan, Lewis & Bockius LLP

(57) ABSTRACT

A horizontal shaft impact crusher, including a crusher housing having an inlet for material to be crushed and an outlet for material that has been crushed. An impeller is mounted on a horizontal shaft in the crusher housing and is operative for rotating around a horizontal axis. Material to be crushed is accelerated by the impeller against a curtain. An adjustment device is provided for adjusting the position of the curtain relative to the impeller. The crusher housing includes at least two guide rails to which the adjustment device is slidably connected. A retaining device is arranged to hold, with a predetermined holding force, the adjustment device in a crusher operation position relative to the guide rails. The adjustment device is movable along the guide rails from the crusher operation position and away from the impeller in response to an excessive force being transferred from the curtain to the adjustment device and exceeding the predetermined holding force.

20 Claims, 6 Drawing Sheets

(56) References Cited

FOREIGN PATENT DOCUMENTS

| | | | |
|---|---|---|---|
| DE | 94 13 571.1 | | 3/1995 |
| EP | 0 728 524 | A1 | 8/1996 |
| EP | 1 964 612 | A1 | 9/2008 |
| ES | 2 289 885 | A1 | 2/2008 |
| FR | 2 893 863 | | 6/2007 |
| WO | WO 2007/110744 | A2 | 10/2007 |

OTHER PUBLICATIONS

Notification of First Office Action (with English Translation) in Chinese patent application No. 201180019400.1 dated Dec. 12, 2013.

* cited by examiner

HORIZONTAL SHAFT IMPACT CRUSHER

This application claims priority under 35 U.S.C. §119 to Swedish Patent Application No. 1050377-9, filed on Apr. 16, 2010, which is incorporated by reference herein in its entirety.

FIELD OF THE INVENTION

The present invention relates generally to a horizontal shaft impact crusher including a crusher housing having an inlet for material to be crushed and an outlet for material that has been crushed, an impeller mounted on a horizontal shaft in the crusher housing and operative for rotating around a horizontal axis, a curtain against which material accelerated by the impeller may be crushed, and an adjustment device for adjusting the position of the curtain relative to the impeller.

BACKGROUND OF THE INVENTION

Horizontal shaft impact crushers are utilized in many applications for crushing hard material, such as pieces of rock, ore, etc. A horizontal shaft impact crusher has an impeller that is made to rotate around a horizontal axis. Pieces of rock are fed towards the impeller and are struck by beater elements mounted on the impeller. The pieces of rock are disintegrated by being struck by the beater elements, and are accelerated and thrown against breaker plates, often referred to as curtains, against which further disintegration occurs. The action of the impeller thus causes the material fed to the horizontal shaft impact crusher to move freely in a crushing chamber and to be crushed upon impact against the beater elements, against the curtains, and against other pieces of material moving around at high speed in the crushing chamber.

Adjustment of the position of the curtain may be made to compensate for both curtain wear and beater element wear. Furthermore, adjustment of the position of the curtain may be made to adjust the size of the crushed material.

U.S. Pat. No. 4,017,035 discloses a horizontal shaft impact crusher which is provided with supporting hydraulic cylinders for adjusting and maintaining the position of the curtain. However, the design of the crusher described in U.S. Pat. No. 4,017,035 is considered to be complex and may be costly to manufacture and/or operate.

The present invention aims at obviating the above-mentioned disadvantages of previously known horizontal shaft impact crushers and at providing an improved crusher. Therefore, a primary object of the invention is to provide a simple and robust horizontal shaft impact crusher that allows for simple adjustment of the position of the curtain relative to the impeller, thereby controlling the wear of the curtain and impeller beater elements while minimizing cost of manufacture and operation of the crusher.

SUMMARY OF THE INVENTION

In an embodiment, the invention provides a horizontal shaft impact crusher, including a crusher housing that has an inlet for material to be crushed and an outlet for material that has been crushed. An impeller is mounted on a horizontal shaft in the crusher housing and is operative for rotating around a horizontal axis. A curtain is provided against which material accelerated by the impeller may be crushed. An adjustment device is included for adjusting the position of the curtain relative to the impeller. The adjustment device is slidably connected to at least two guide rails provided with the crusher housing. A retaining device is arranged to hold, with a predetermined holding force, the adjustment device in a crusher operation position relative to the guide rails. The adjustment device is movable along the guide rails from the crusher operation position and away from the impeller in response to an excessive force being transferred from the curtain to the adjustment device and exceeding the predetermined holding force.

An advantage of this embodiment of the horizontal shaft impact crusher is that the adjustment of the curtains may be carried out in a simple and mechanically stable manner since the adjustment device may be arranged to slide easily along the guide rails when not retained by the retaining device. Furthermore, a robust and reliable mounting of the crusher curtains in different positions may be achieved. The adjustment device can still slide, in a predictable manner, when exposed to excessive forces also when the adjustment device is retained by the retaining device. When retained, the adjustment device is slidable in response to excessive forces caused by, for example, non crushable objects. Hence, a reliable overload protection is achieved.

In response to a force sufficiently large to overcome the holding force of the retaining device the adjustment device can thus slide although retained by the retaining device. In such a situation, which may be the result of a non crushable object being inadvertently introduced to the crusher, the adjustment device thus slides against the holding force of the retaining device.

A further advantage of this embodiment of the crusher is that the manufacturing costs thereof may be reduced since the adjustment device may be retained by a mechanical retaining device, such as a bolt, and thus no hydraulic device is needed to retain the curtains in a desired position.

According to one embodiment the adjustment device is retained by a hydraulic or a pneumatic device in order to enable adjustment of the curtain in a very simple manner by, e.g., a small hydraulic cylinder. Such a hydraulic or pneumatic device only needs to be capable to generate a certain friction force between the adjustment device and the guide rods and may thus be small compared to the supporting hydraulic cylinders used in U.S. Pat. No. 4,017,035.

In another embodiment, each of the guide rails has a receiving portion adapted to at least partly enclose a connection portion of the adjustment device in order to improve the robustness and stability of the device when retained to the guide rails and the guidance stability when adjustment of the curtain is carried out. Furthermore, improved control as regards the holding force of the retaining device is achieved.

The profile of the connection portion may be V-shaped and arranged with its sharp end facing the receiving portion of the respective guide rail.

In another embodiment, the adjustment device further includes at least one resilient member arranged to dampen forces exerted on the curtain. The at least one resilient member can include a spring.

In one embodiment, the adjustment device is provided with a hydraulic device which is operative for adjusting the distance between a cross beam to which the curtain is connected and the housing of the crusher. This has the advantage that the curtain can be positioned in an easy and safe manner, thereby enabling production to be maintained quickly and easily after, e.g., an overload situation.

In another embodiment, the adjustment device further includes a compression plate which supports the at least one resilient member and is connected to the curtain, the compression plate being retractable away from the impeller by the hydraulic device.

In yet another embodiment, the adjustment device is further provided with a safety mechanism for preventing the curtain to come into contact with the beater elements of the impeller.

According to one embodiment a hydraulic device is operative for retracting the curtain from the impeller against the force of at least one resilient member with the adjustment device still in the crusher operation position, such that blockages can be cleared from the crusher without having to release the adjustment device. An advantage of this embodiment is that blockages that do not cause forces exceeding the predetermined holding force can be cleared from the crusher without having to dismount any parts, such as the adjustment device.

The adjustment device can include a horizontal cross beam on which the at least one connection portion is arranged, in order to achieve a very robust design.

In an embodiment, the at least one connection portion is arranged in alignment with a longitudinal center plane of a cross beam, in order to further improve the stability of the adjustment device.

According to one embodiment the adjustment device is provided with a cross beam and two V-shaped connection portions, e.g., in the form of V-shaped guide blocks, both of which are aligned to a longitudinal center plane of the cross beam. This embodiment has the advantage that the stability and/or robustness of the adjustment device may be even further improved.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
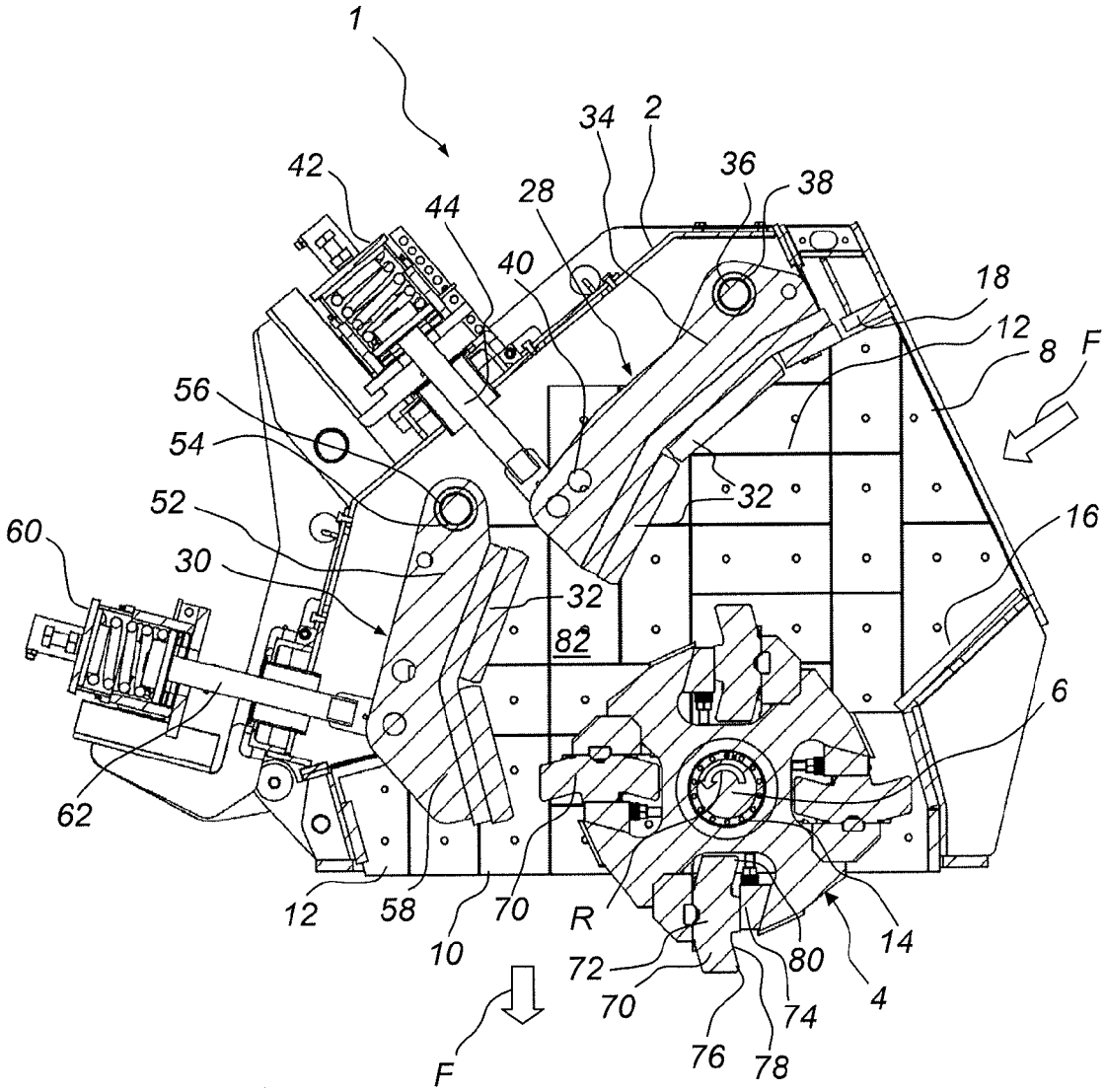
FIG. 1 is a section view and illustrates, schematically, a horizontal shaft impact crusher according to an embodiment of the present invention.

FIG. 1 is a cross-section and illustrates, schematically, a horizontal shaft impact crusher 1. The horizontal shaft impact crusher 1 includes a housing 2 in which an impeller 4 is arranged. A motor, not illustrated for reasons of maintaining clarity of illustration, is operative for rotating a horizontal shaft 6 on which the impeller 4 is mounted. As alternative to the impeller 4 being fixed to the shaft 6, the impeller 4 may rotate around the shaft 6. In either case, the impeller 4 is operative for rotating around a horizontal axis, coinciding with the center of the horizontal shaft 6.

Material to be crushed is fed to an inlet 8 for material to be crushed. The crushed material leaves the crusher 1 via an outlet 10 for material that has been crushed.

The housing 2 is provided with a plurality of wear protection plates 12 that are operative for protecting the walls of the housing 2 from abrasion and from impact by the material to be crushed. Furthermore, the housing 2 includes a bearing 14 for the horizontal shaft 6. A lower feed plate 16 and an upper feed plate 18 are arranged at the inlet 8. The feed plates 16, 18 are operative for providing the material fed to the crusher 1 with a suitable direction with respect to the impeller 4.

The crusher 1 includes a first curtain 28, and a second curtain 30. Each curtain 28, includes at least one wear plate 32 against which material may be crushed.

A first end 34 of the first curtain 28 has been mounted by a horizontal first pivot shaft 36 extending through an opening 38 formed in the first curtain 28 at the first end 34. The first pivot shaft 36 extends further through openings in the housing 2 to suspend the first end 34 in the housing 2. A second end 40 of the first curtain 28 is connected to a first adjustment device 42 including two parallel adjustment bars 44, of which only one bar 44 is visible in FIG. 1.

A first end 52 of the second curtain 30 has been mounted by a horizontal second pivot shaft 54 extending through an opening 56 formed in the second curtain 30 at the first end 52. The second pivot shaft 54 extends further through openings in the housing 2 to suspend the first end 52 in the housing 2. A second end 58 of the second curtain 30 is connected to a second adjustment device 60 including two parallel adjustment bars 62, of which only one bar 62 is visible in FIG. 1. The second adjustment device 60 may be of a similar design as the first adjustment device 42, which will be described in more detail hereinafter.

The impeller 4 is provided with four beater elements 70, each such beater element 70 having a "banana" shape, as seen in cross-section. Each beater element 70 has a central portion 72 which is operative for co-operating with a mounting block 74 being operative for pressing the back of the beater element 70 towards the impeller 4 to keep the beater element 70 in position. An arrow R indicates the direction of rotation of the impeller 4. A leading edge 76 of the beater element 70 extends in the direction of rotation R, such that a scoop-area 78 is formed between the central portion 72 and the leading edge 76. The beater element 70 is symmetric around its central portion 72, such that once the leading edge 76 has been worn out, the beater element 70 can be turned and mounted with its second leading edge 80 operative for crushing material. The area formed between the impeller 4 and the first and second curtains 28, 30 can be called a crushing chamber 82 of the crusher 1.

In operation, material to be crushed is fed to the inlet 8. The material will first reach the first curtain 28, being located upstream of the second curtain 30 as seen with respect to the direction of travel of the material. The feed plates 16, 18 direct the material towards the impeller 4 rotating at, typically, 400-850 rpm. When the material is hit by the beater elements 70 it will be crushed and accelerated against the wear plates 32 of the first curtain 28 where further crushing occurs. The material will bounce back from the first curtain 28 and will be crushed further against material travelling in the opposite direction and, again, against the beater elements 70. When the material has been crushed to a sufficiently small size it will move further down the crusher chamber 82, and will be accelerated, by the beater elements 70, towards the wear plates 32 of the second curtain 30, being located downstream of the first curtain 28. Hence, the material will move freely around in the crushing chamber 82, and will be crushed against the beater elements 70, against the wear plates 32 of the curtains 28, 30, and against other pieces of material circling around, at a high velocity, in the crusher 1. Arrows F indicate the path of the material through the crusher 1.

By adjusting the longitudinal position of the adjustment bar 44 in relation to the housing 2, the first curtain 28 may be pivoted around the first pivot shaft 36 until an optimum distance between the second end 40 and the impeller 4 has been obtained, with respect to the properties, as regards, e.g., size and hardness, of the material to crushed. Hence, the adjustability of the distance between the first curtain 28 and the impeller 4 is largest at that location, i.e., at the second end 40 of the first curtain 28, where the distance between the first curtain 28 and the impeller 4 is normally the smallest. In a similar manner the second adjustment device 60 may be utilized for making the second curtain 30 pivot around the second pivot shaft 54 until a suitable distance between the impeller 4 and the second end 58 of the second curtain 30 has been obtained.

Figure 2:
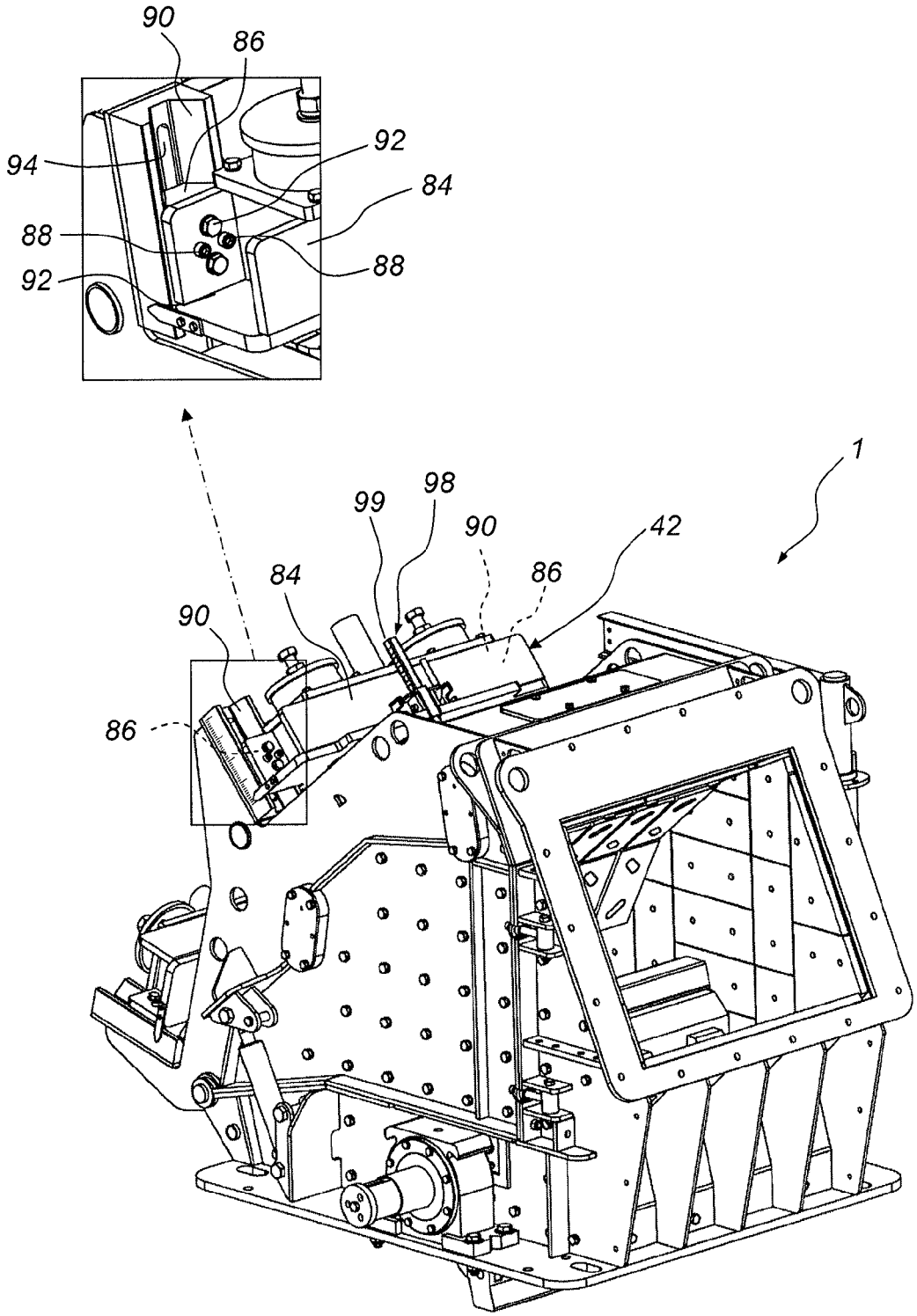
FIG. 2 is a perspective view of the crusher shown in FIG. 1.
Figure 3A:
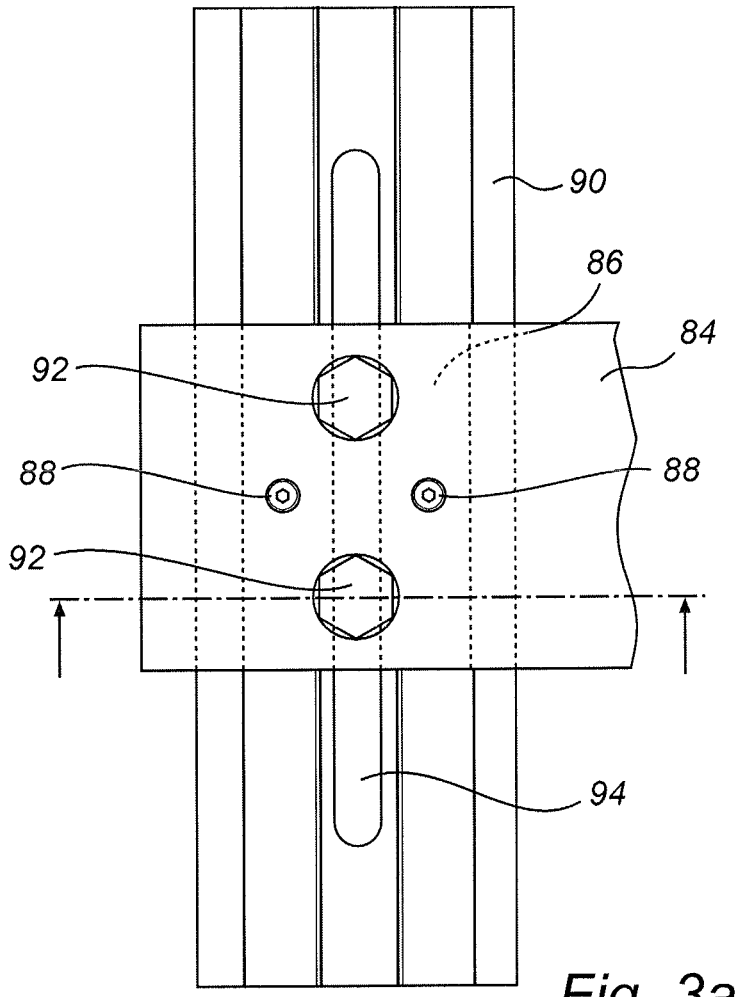
FIG. 3*a* is a plan view and illustrates, schematically, a guide block received in a guide rail of the crusher shown in FIG. 1.
Figure 3B:
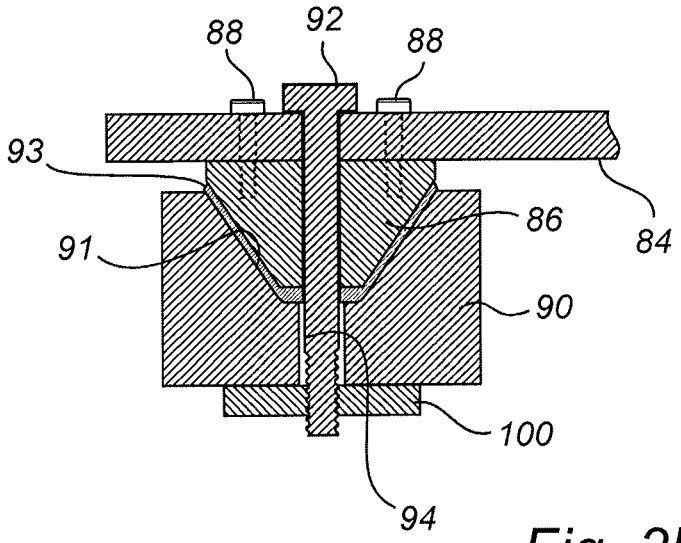
FIG. 3*b* is a section view and illustrates the guide block and guide rail shown FIG. 3*a;*

As illustrated in FIGS. 2, 3*a* and 3*b* the adjustment device 42 includes a supporting structure, in the form of a cross beam 84, and two connection portions, in the form of V-shaped guide blocks 86, which are arranged in opposite horizontal ends of the cross beam 84 and are fastened to the cross beam 84 by screws 88. Each of the two guide blocks 86 is received in a respective guide rail 90 mounted on the housing 2 and extending away from the housing 2, as illustrated in FIG. 2. Each guide rail 90 is provided with a receiving portion having a shape that corresponds to the shape of the connection part of the cross beam 84. In this embodiment each guide rail 90 is provided with a V-shaped groove 91 to form a V-shaped receiving portion that corresponds to the V-shaped guide block 86, as is best illustrated in FIG. 3*b*.

The guide blocks 86 can slide along the guide rails 90. Adjustment of the cross beam 84, and thereby of the first curtain 28 which is connected to the cross beam 84 via the bars 44, to a correct position in relation to the impeller 4 with respect to the properties of the material to be crushed may be carried out by adjusting the position of cross beam 84 by having the guide blocks 86 slide relative to the guide rails 90.

As illustrated in FIG. 3*b* the crusher 1 further includes a retaining device, in the form of retaining bolts 92 and clamping plates 100, for tightening the guide blocks 86 to the guide rails 90. In this embodiment each guide block 86 is tightened by two retaining bolts 92, each of which is received in a respective bore of the respective clamping plate 100. The clamping plate 100 is provided with the two bores each having an inner thread, such that each retaining bolt 92 can be tightened to the clamping plate 100 without the need for any nut, as illustrated in FIG. 3*b*. The guide blocks 86 slide easily along the guide rails 90 when the bolts 92 are unscrewed, or at least loosened, and remain slidable, although only when a friction force is overcome, in a predictive way even when the bolts 92 are tightened. Optionally, the groove 91, and/or the guide block 86, may be provided with a friction coating 93. The friction coating 93, which may be, for example a proprietary disk brake lining material, provides a large and predictable friction force between the guide block 86 and the guide rail 90.

Each guide rail 90 is provided with a longitudinal slot 94, as is best illustrated in FIGS. 3*a* and 3*b*, which slot 94 extends along the guide rail 90 and is configured to receive the retaining device, in this case the retaining bolt 92, for tightening the guide block 86 to the guide rail 90. The slot 94 makes it possible for the guide block 86 with the retaining bolt 92 mounted therein to slide along the guide rail 90.

As mentioned above each of the guide rails 90 has a groove 91 with a shape that is complementary to the corresponding V-shaped guide block 86. The V-shaped guide block 86 in combination with the V-shaped groove 91 of the guide rail 90 provides for lateral guidance of the cross beam 84 and helps to prevent the cross beam 84 from twisting during crusher 1 operation and adjustment.

After adjusting the position of the cross beam 84 to a desired position, i.e., a position at which the first curtain 28 is located at a desired distance from the impeller 4 with respect to the size of the material that is to be crushed, the bolts 92 are tightened to such extent, for example to a predetermined torque, that a predetermined holding force in the form of the friction force between the V-shaped guide blocks 86 and the grooves 91 of the guide rails 90 is generated. This predetermined holding force is large enough to prevent relative displacement between the cross beam 84 and the crusher housing 2 under normal crushing conditions. Hence, the bolts 92 are tightened to a specific tightening moment that provides the desired frictional force between the guide blocks 86 and the guide rails 90. The first curtain 28 is thus prevented from pivoting around the first pivot shaft 36 under normal crushing conditions. If a bulky and non crushable object is introduced into the crusher 1 the forces exerted on the first curtain 28, to which the adjustment device 42 is connected, is raised significantly. When such forces, denoted excessive forces, exceed the predetermined holding force in the form of the friction force between the V-shaped guide blocks 86 and the grooves 91 of the guide rails 90 the guide blocks 86 slide along the guide rails 90, in a direction away from the housing 2 and away from the impeller 4, causing the first curtain 28 to pivot around the first pivot shaft 36, thereby increasing the distance between the impeller 4 and the first curtain 28 such that the non-crushable object can pass through the crusher 1. In this manner damage to parts of the crusher 1 caused by non-crushable objects introduced to the crusher 1 can be avoided.

Figure 4:
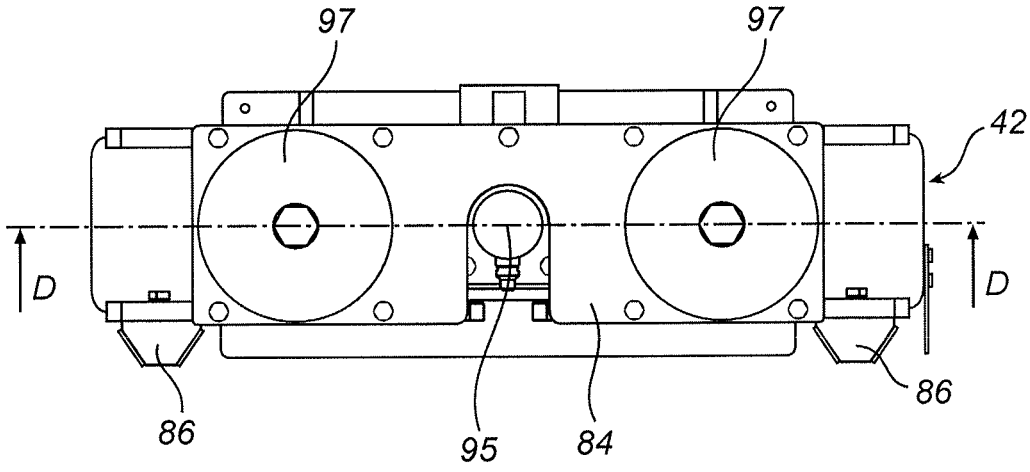
FIG. 4 is a top view and illustrates an adjustment device of the crusher shown in FIG. 1.
Figure 5A:
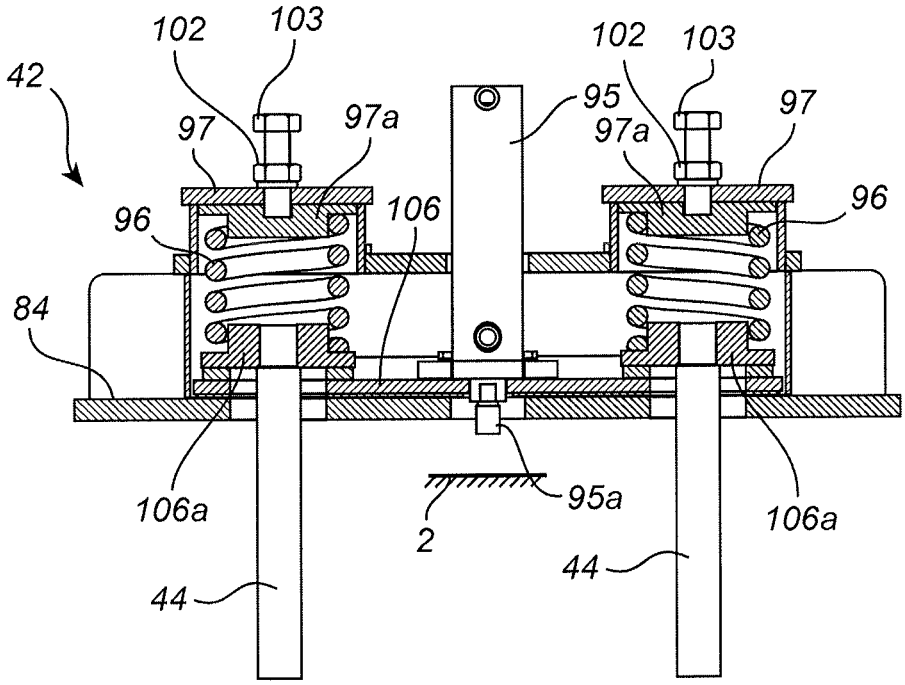
FIGS. 5*a-c* are sections of the adjustment device shown in FIG. 4, as seen along the arrows D-D.
Figure 5B:
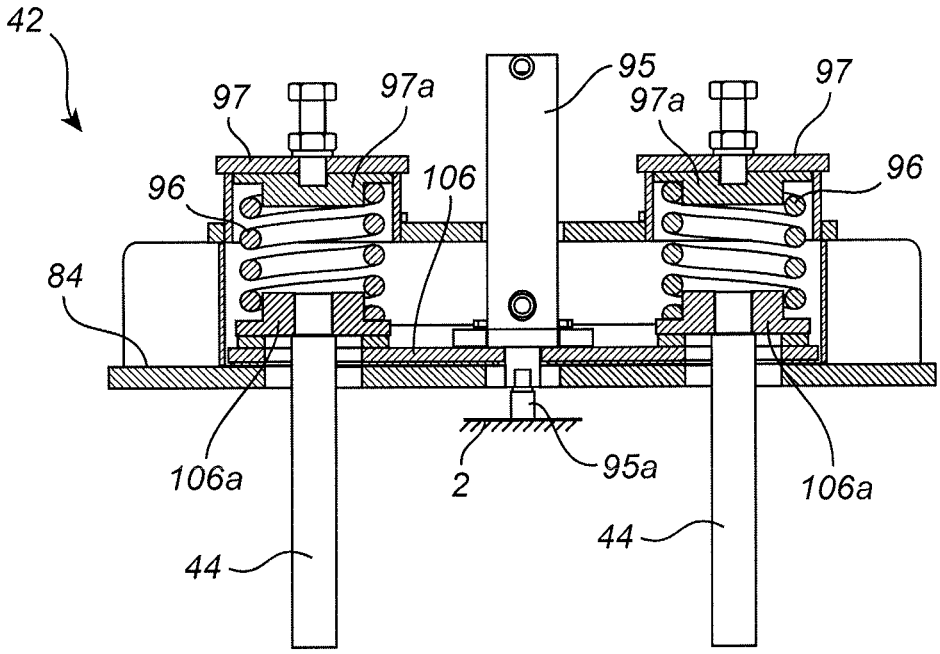
Figure 5C:
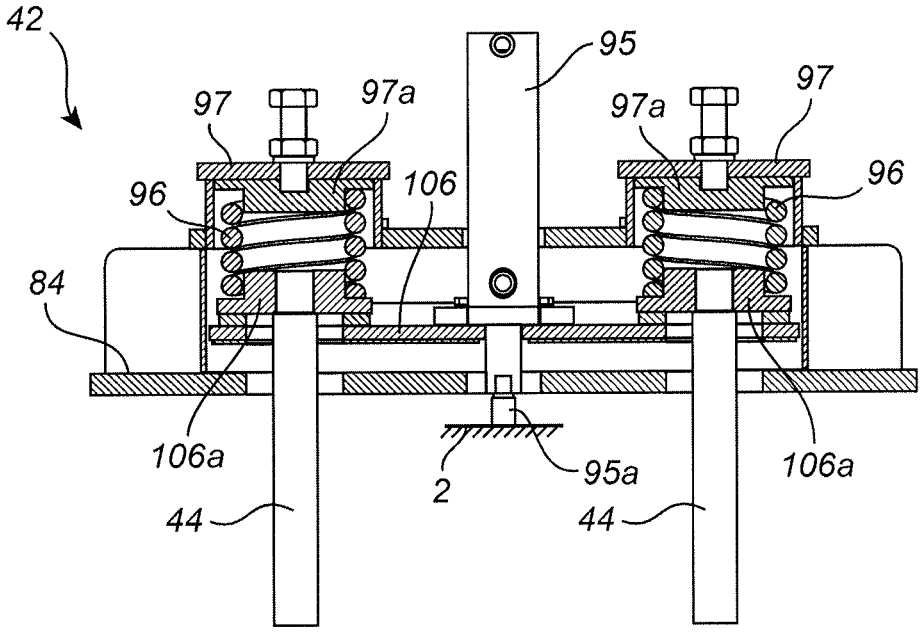

FIG. 4, FIG. 5*a*, FIG. 5*b* and FIG. 5*c* illustrate further details of the adjustment device 42. FIG. 5*a* illustrates the adjustment device 42 when the crusher 1 is in normal crusher operation. FIG. 5*b* illustrates the adjustment device 42 when the position of the first curtain 28 is adjusted. FIG. 5*c* illustrates the adjustment device 42 when the first curtain 28 is temporarily retracted to empty the crusher 1 of a minor blocking. The adjustment device 42 includes a hydraulic cylinder 95 which is mounted on the cross beam 84 and is arranged to aid first curtain 28 adjustment.

The hydraulic cylinder 95 includes a piston 95*a* which abuts, during an adjustment procedure, the roof of the housing 2, as illustrated in FIG. 5*b*. Hence, by supplying more or less of a pressurized fluid, such as a hydraulic medium, such as hydraulic oil, or pressurized air, to the hydraulic cylinder 95 the distance between the cross beam 84 and the housing 2 may easily be adjusted, such that a desired distance is obtained between the impeller 4, which is fixed to the housing 2, and the first curtain 28, which is fixed, via the bars 44, to the cross beam 84 of the adjustment device 42. This has the advantage that the first curtain 28 can be positioned in an easy and safe manner. Once the first curtain 28 has reached its correct position it is locked in place by tightening the V-shaped blocks 86 against the guide rails 90 using the bolts 92, as described hereinbefore with reference to FIGS. 2, 3*a* and 3*b*. After adjustment and tightening of the retaining bolts 92 the pressure in the hydraulic cylinder 95 can be released, and the abutment against the housing 2 may be relieved. Hence, no pressure in the hydraulic cylinder 95 is needed during operation of the crusher 1, and the hydraulic cylinder 95 is inactive during crusher 1 operation. Optionally, the piston 95*a* may be retracted such that it is no longer in contact with the housing 2 during crusher 1 operation, as is illustrated in FIG. 5*a*.

The first curtain 28, which is connected to the cross beam 84 of the adjustment device 42, may be repositioned in order to change crusher 1 settings by first loosening the bolts 92 and then displacing the cross beam 84 along the guide rails 90 with the help of the hydraulic cylinder 95.

The adjustment device 42 further includes resilient members, in the form of springs 96, as is best illustrated in FIG. 5*a*, that are pre-tensioned between the cross beam 84 and respective compression plates 97, for dampening of the forces exerted on the first curtain 28 by the material in the crushing chamber 82 during normal crusher 1 operation. The degree of pre-tensioning of the springs 96 can be adjusted by loosening a locknut 102 and a tightening screw 103 in order to adjust the position of upper spring seats 97*a* relative to the compression plates 97. Such adjustment of the degree of pre-tensioning of the springs 96 is made to adjust the degree of dampening of the forces exerted during normal crusher 1 operation.

The adjustment device 42 is further provided with a mechanical safety device 98, illustrated in FIG. 2, for preventing the first curtain 28 to come into contact with the beater elements 70 of the impeller 4 in case of failure of the adjustment device 42. The mechanical safety device 98 includes a bar 99 which is mounted on the cross beam 84 and which is adjusted to such a length that it will abut the housing 2, in a similar manner as the piston 95*a* of hydraulic cylinder 95 abuts the housing 2 as illustrated in FIG. 5*a*, before the first curtain 28 comes into contact with the impeller 4. Hence, after adjusting the cross beam 84 to its desired position in accordance with the above description, the bar 99 is mounted on the cross beam 84 in such a position that there is a clearance of typically 10-50 mm between the bar 99 and the housing 2. Hence, in a situation of failure of, for example, the guide blocks 86, the cross beam 84 may fall towards the housing 2, but not more than 10-50 mm before the bar 99 abuts the housing 2. Hence, the bar 99 prevents the first curtain 28 from coming into contact with the impeller 4 in such a situation of guide block 86 failure.

The retaining bolts 92 are arranged to hold the adjustment device 42 in a desired crusher 1 operation position as long as the forces applied to the guide blocks 86 do not exceed the predetermined holding force. However, the adjustment device 42 is slidable in response to an excessive force that overcomes the predetermined holding force generated by the retaining bolts 92. The guide blocks 86 may then slide against the friction force generated between the guide blocks 86 and the grooves 91 of the guide rails 90 by the tightened retaining bolts 92 and the respective clamping plates 100.

When material is crushed in the crusher 1, forces are applied to the adjustment device 42 via the first curtain 28. As long as the crusher 1 is fed with material of the type the crusher 1 is designed to crush, the predetermined holding force is not exceeded which means relative displacement of the adjustment device 42 is prevented. However, it may happen that a non-crushable object of a certain size is introduced into the crusher 1. Such a non crushable object will exert excessive forces to the first curtain 28 and the adjustment device 42. When a force exceeding the predetermined holding force is exerted on the adjustment device 42, the predetermined holding force, i.e., the friction force between the guide blocks 86 and the grooves 91 generated by the retaining bolts 92, is no longer enough to prevent the adjustment device 42 from sliding along the guide rails 90 away from the housing 2 and away from the impeller 4, such that the first curtain 28 is moved away from the impeller 4. Hence, in an overload situation, i.e., when the predetermined holding force is exceeded, displacement of the first curtain 28 is enabled, hence avoiding damage to the first curtain 28 and the adjustment device 42.

As long as forces acting on the adjustment device 42 do not exceed the predetermined value, the retaining bolts 92 prevent relative displacement of the adjustment device 42. The first curtain 28 will thus maintain the position to which it is adjusted as long as no overload situation occurs. Since the first curtain 28 is held in position by a mechanical fastening device, in the form of tightened bolts 92, no hydraulic pressure is needed to secure the first curtain 28 position. A reliable and simple overload protection is thus achieved.

The guide blocks 86 together form a slidable member which prevents relative displacement of the adjustment device 42 under normal conditions and which allows relative displacement in case of an overload situation.

FIGS. 5*a*, 5*b* and 5*c* further illustrate a crossbeam compression plate 106. The crossbeam compression plate 106 supports lower spring seats 106*a*. In the situation illustrated in FIG. 5*a* the crusher 1 is in normal operation, and the cross beam compression plate 106 rests adjacent to the cross beam 84. Sometimes the crusher 1 may become blocked with feed material that is to be crushed, because the feed has been too large in relation to the capacity of the crusher 1. Such blocking would normally not cause an overload situation of the type that would cause the forces on the first curtain 28 to exceed the above mentioned predetermined holding forces of the guide blocks 86. A similar situation could occur if an un-crushable object of intermediate size enters the crusher 1. Such an object could block the crusher 1, without causing forces that exceed the predetermined holding force. In such situations a quick cleansing sequence can be initiated. In the quick cleansing sequence the hydraulic cylinder 95 is first activated such that the piston 95*a* abuts the housing 2, as illustrated in FIG. 5*b*. The hydraulic cylinder 95 is then further activated to such degree that it lifts the cross beam compression plate 106 from its position adjacent to the cross beam 84. Such lifting is made against the force of the springs 96, that become compressed between the upper and lower spring seats 97*a*, 106*a*, as is illustrated in FIG. 5*c*. The lifting of the cross beam compression plate 106 to the position illustrated in FIG. 5*c* causes a retraction of the adjustment bars 44 and hence a retraction of the first curtain 28 away from the impeller 4, illustrated in FIG. 1. Depending on the size of the springs 96, such retraction could typically amount to 50-150 mm. Hence, the quick cleansing sequence illustrated with reference to FIG. 5*b* and FIG. 5*c* causes a temporary increase in the distance between the first curtain 28 and the impeller 4 such that any blockage, which may be caused by excessive feed of material and/or an un-crushable object of intermediate size, can pass through the crusher 1. After the blockage has passed through the crusher 1, the hydraulic cylinder 95 is inactivated, causing the cross beam compression plate 106 returning, under the force exerted on it by the springs 96, to its normal position, as illustrated in FIG. 5*a*. Throughout the quick cleansing sequence the setting of the guide blocks 86 remains intact. Hence, with the hydraulic cylinder 95 and the cross beam compression plate 106 co-operating, blockages can be cleared quickly from the crusher 1 with minimal interruption of operation and with minimal manual efforts.

Hereinbefore it has been described that the crusher 1 is provided with a first curtain 28, and a second curtain 30 located downstream of the first curtain 28. It will be appreciated that a crusher 1 may also be provided with further curtains, such as a third curtain located downstream of the second curtain 30. An adjustment device 42 of the type that has been described in detail hereinbefore can be arranged for one, two, or all of the curtains 28, 30 of a crusher 1. Hence, the adjustment device 60 being operative for controlling the position of the second curtain 30 could be similar to the adjustment device 42.

Hereinbefore it has been described that the second adjustment device 60 operative for adjusting the position of the second curtain 30 may be of a similar design as the first adjustment device 42 operative for adjusting the position of the first curtain 28. It will be appreciated that the second adjustment device 60 may, optionally, be arranged without a safety device 98, since the second curtain 30, hanging, as illustrated in FIG. 1, in a more or less vertical position, is less likely to come into contact with the impeller 4.

In the described embodiment the adjustment device 42 includes a hydraulic cylinder 95 for positioning the first curtain 28 into a correct position. It is, however, also possible to make the adjustment device 42 entirely mechanical, which may reduce investment and maintenance costs.

Hereinbefore it has been described that the V-shaped guide blocks 86 are mounted on the adjustment device 42 and co-operate with V-shaped grooves 91 on the respective guide rails 90. It will be appreciated that the opposite arrangement is also possible, i.e., that the adjustment device 42 could, as alternative, be provided with V-shaped grooves co-operating with guide rails being generally V-shaped blocks. Furthermore, other shapes are also possible, including guide blocks 86 having a cross-section having the shape of a half-circle or some other suitable shape. Preferably, the shape is such that it provides both a predictable friction and a guidance in the horizontal direction.

In the described embodiment retaining bolts 92 are arranged to hold the adjustment device 42 in a desired crusher 1 operation position. It is realized that other devices, including a small hydraulic cylinder, capable of generating the required friction force between the guide block 86 and the guide rail 90, may be used instead of bolts 92. According to one embodiment the retaining device includes two small hydraulic cylinders.

Hereinbefore it has been described that the adjustment device 42 includes a compression plate 106 supporting spring seats 106*a* of each of the springs 96. In an alternative embodiment the first adjustment device 42 may include two compression plates 106, each of which support a respective spring seat. A number of hydraulic devices operative for moving each of the two compression plates may then be needed in order to provide a robust adjustment device 42.

In the described embodiment resilient members in the form of springs 96 are arranged to dampen forces exerted on the first curtain 28. Alternatively, such a resilient member may be formed from another component having resilient characteristics, such as, for instance, a component formed from an elastic material.

It is further realized that the adjustment device 42 may include a resilient member in the form of one single resilient member, such a single spring being, preferably, arranged on the cross beam 84 centrally between the two bars 44.

Hereinafter a crusher according to a second embodiment will be described with reference to FIGS. 6 and 7. Many features disclosed in the first embodiment are also present in the second embodiment with similar reference numerals identifying similar or same features. Having mentioned this, the description will focus on explaining the differing features of the second embodiment.

Figure 6:
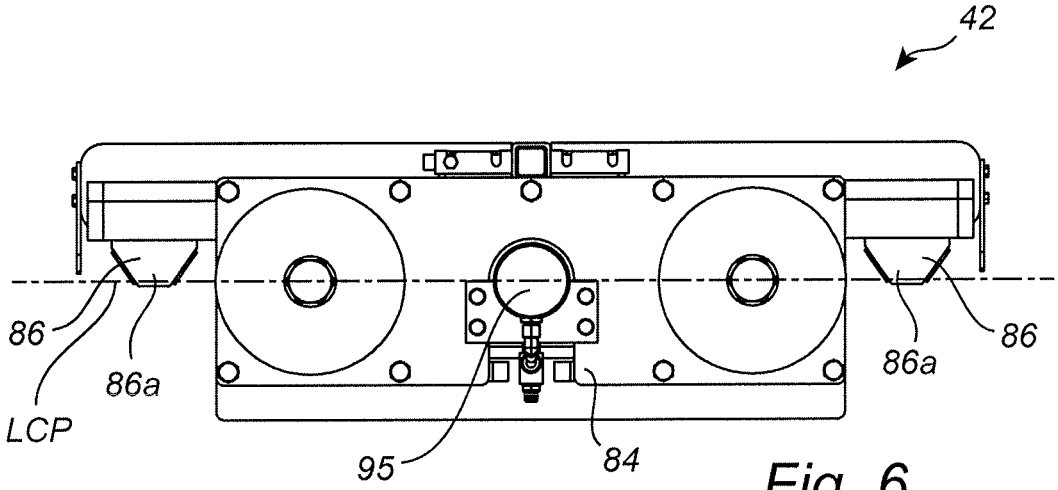
FIG. 6 is a top view and illustrates an adjustment device of a horizontal shaft impact crusher according to a second embodiment of the present invention.

FIG. 6 is a top view and illustrates, in a perspective similar to that of FIG. 4, a cross beam 84 of a crusher according to the second embodiment. The second embodiment differs from the first embodiment in that each guide block 86 of the cross beam 84, which is horizontal, like the cross-beam 84 illustrated in FIG. 2, is aligned to a longitudinal center plane LCP of the cross beam 84. A lower portion 86*a* of each guide block 86 is arranged in alignment with the longitudinal center plane LCP of the cross beam 84, as illustrated in FIG. 6.

Hence, in this embodiment the horizontal shaft impact crusher includes a first and a second V-shaped connection portion, in the form of V-shaped guide blocks 86, fastened to a cross beam 84. The V-shaped guide blocks 86 are centrally arranged, i.e. arranged in alignment with a center plane LCP of the cross beam 84, as illustrated in FIG. 6. The V-shaped guide blocks 86 are thus aligned to a plane, LCP, that extends through each of the adjustment bars 44, illustrated in FIG. 1, and the hydraulic cylinder 95.

This embodiment has the advantage that the stability of the adjustment device 42 is further improved. A first curtain 28 position may be adjusted using the hydraulic cylinder 95 as described hereinbefore. By arranging the V-shaped guide blocks 86 adjacent to the center plane LCP of the cross beam 84, as illustrated in FIG. 6, an even smoother movement during adjustment of a first curtain 28 connected to the cross beam 84 is enabled. Furthermore, jamming effects that may occur during relative movement between the adjustment device 42 and the guide rails 90, illustrated in FIG. 2, during adjustment and/or in response to excessive forces as explained hereinbefore may be prevented. This embodiment thus also has the advantage that an even more robust and reliable adjustment device 42 is achieved.

Figure 7:
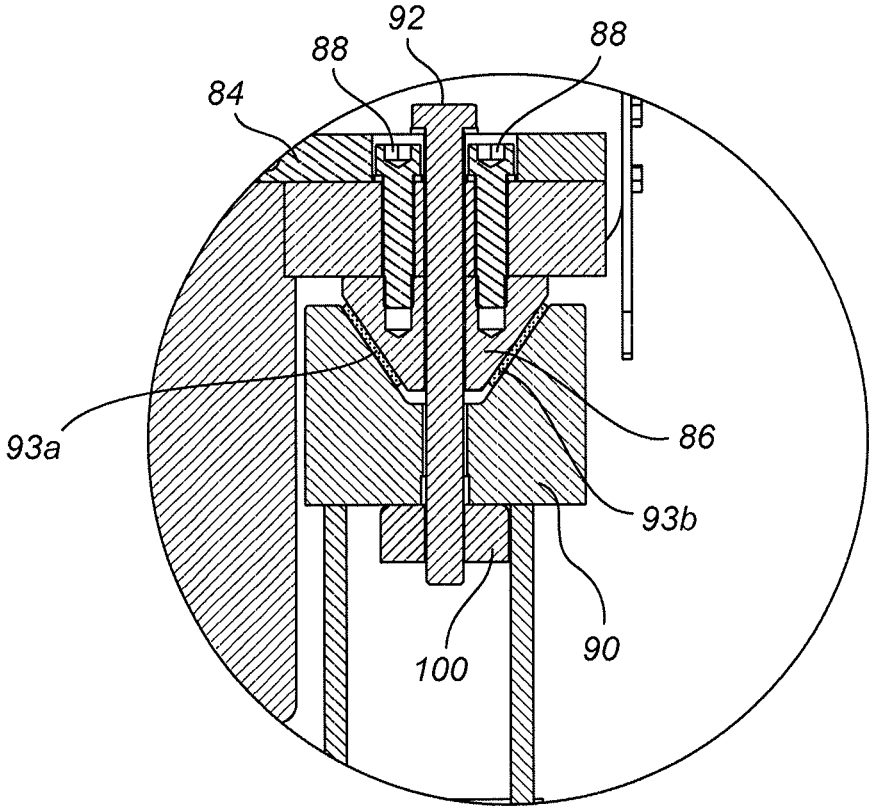
FIG. 7 is a section of a part of the adjustment device shown in FIG. 6.

The second embodiment also differs in that the bolts 88 securing the guide block 86 to the cross beam 84 are countersunk, as illustrated in FIG. 7 in a perspective similar to that of FIG. 3*b*, in order to make it easier for an operator to quickly find the retaining bolt 92 in case of a first curtain 28 adjustment.

Furthermore, the second embodiment also differs in that the friction coating 93 includes two separate friction coating 93 elements 93*a* and 93*b*, as illustrated in FIG. 7, in order to improve attachment of the friction coating 93 and reduce the wear, and thus prolong the service life of the friction coating 93.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A horizontal shaft impact crusher, comprising:

a crusher housing having an inlet for material to be crushed and an outlet for material that has been crushed;

an impeller mounted on a horizontal shaft in the crusher housing and operative for rotating around a horizontal axis;

a curtain against which material accelerated by the impeller may be crushed;

an adjustment device for adjusting a position of the curtain relative to the impeller;

at least two guide rails provided with the crusher housing to which the adjustment device is slidably connected; and a retaining device arranged to hold, with a predetermined holding force, the adjustment device in a crusher operation position relative to the guide rails, the adjustment device being movable along the guide rails from the crusher operation position and away from the impeller in response to an excessive force being transferred from the curtain to the adjustment device and exceeding the predetermined holding force.

2. A horizontal shaft impact crusher comprising:

a crusher housing having an inlet for material to be crushed and an outlet for material that has been crushed;

an impeller mounted on a horizontal shaft in the crusher housing and operative for rotating around a horizontal axis;

a curtain against which material accelerated by the impeller may be crushed;

an adjustment device for adjusting a position of the curtain relative to the impeller;

at least two guide rails provided with the crusher housing to which the adjustment device is slidably connected; and a retaining device arranged to hold, with a predetermined holding force, the adjustment device in a crusher operation position relative to the guide rails, the adjustment device being movable along the guide rails from the crusher operation position and away from the impeller in response to an excessive force being transferred from the curtain to the adjustment device and exceeding the predetermined holding force, wherein one of the adjustment device and the guide rails is provided with at least one connection portion and the other one of the adjustment device and the guide rails is provided with at least one receiving portion, which is adapted to at least partly enclose the at least one connection portion.

3. The horizontal shaft impact crusher according to claim 2, wherein each guide rail has a receiving portion adapted to at least partly enclose a connection portion of the adjustment device.

4. The horizontal shaft impact crusher according to claim 3, wherein the receiving portion is complementary shaped to the connection portion.

5. The horizontal shaft impact crusher according to claim 3, wherein a profile of the connection portion is V-shaped and is arranged with a sharp end facing the receiving portion of the respective guide rail.

6. The horizontal shaft impact crusher according to claim 2, wherein a profile of the receiving portion is V-shaped and is arranged with an open end facing the connection portion of the adjustment device.

7. The horizontal shaft impact crusher according to claim 1, wherein the guide rail is provided with a longitudinal slot for receiving the retaining device.

8. The horizontal shaft impact crusher according to claim 1, wherein the adjustment device further comprises a resilient device arranged to dampen forces exerted on the curtain.

9. The horizontal shaft impact crusher, according to claim 1, wherein the adjustment device further comprises resilient means arranged to dampen forces exerted on the curtain.

10. The horizontal shaft impact crusher according to claim 1, wherein a hydraulic device is operative for retracting the curtain from the impeller against the force of at least one resilient member with the adjustment device still in the crusher operation position, such that blockages can be cleared from the crusher without having to release the adjustment device.

11. A horizontal shaft impact crusher, comprising:

a crusher housing having an inlet for material to be crushed and an outlet for material that has been crushed;

an impeller mounted on a horizontal shaft in the crusher housing and operative for rotating around a horizontal axis;

a curtain against which material accelerated by the impeller may be crushed;

an adjustment device for adjusting a position of the curtain relative to the impeller;

at least two guide rails provided with the crusher housing to which the adjustment device is slidably connected; and a retaining device arranged to hold, with a predetermined holding force, the adjustment device in a crusher operation position relative to the guide rails, the adjustment device being movable along the guide rails from the crusher operation position and away from the impeller in response to an excessive force being transferred from the curtain to the adjustment device and exceeding the predetermined holding force, wherein a hydraulic device is operative for retracting the curtain from the impeller against the force of at least one resilient member with the adjustment device still in the crusher operation position, such that blockages can be cleared from the crusher without having to release the adjustment device, and wherein the adjustment device further comprises a compression plate supporting the at least one resilient member and connected to the curtain, the compression plate being retractable away from the impeller by the hydraulic device.

12. The horizontal shaft impact crusher according to claim 1, wherein the adjustment device further comprises a hydraulic device which is operative for adjusting the distance between a cross beam to which the curtain is connected and the crusher housing.

13. The horizontal shaft impact crusher according to claim 1, wherein the adjustment device is further provided with a safety mechanism for preventing the curtain to come into contact with the impeller.

14. The horizontal shaft impact crusher according to claim 2, wherein the adjustment device comprises a horizontal cross beam on which the at least one connection portion is arranged.

15. The horizontal shaft impact crusher according to claim 14, wherein the at least one connection portion is aligned to a longitudinal center plane of the cross beam.

16. The horizontal shaft impact crusher according to claim 15, wherein a first and a second V-shaped connection portion are arranged on the cross beam, the first and second V-shaped connection portions being aligned to a longitudinal center plane of the cross beam.

17. The horizontal shaft impact crusher according to claim 2, wherein the guide rail is provided with a longitudinal slot for receiving the retaining device.

18. The horizontal shaft impact crusher according to claim 2, wherein the adjustment device further comprises a resilient device arranged to dampen forces exerted on the curtain.

19. The horizontal shaft impact crusher according to claim 2, wherein the adjustment device further comprises resilient means arranged to dampen forces exerted on the curtain.

20. The horizontal shaft impact crusher according to claim 2, wherein the adjustment device further comprises a hydraulic device which is operative for adjusting the distance between a cross beam to which the curtain is connected and the crusher housing.

* * * * *